US006364625B1

(12) United States Patent
Sertier

(10) Patent No.: US 6,364,625 B1
(45) Date of Patent: Apr. 2, 2002

(54) JET PUMP COMPRISING A JET WITH VARIABLE CROSS-SECTION

(75) Inventor: Bruno Sertier, Châlons en Champagne (FR)

(73) Assignee: Marwal Systems (FR)

( * ) Notice: Subject to any disclaimer, the term of this patent is extended or adjusted under 35 U.S.C. 154(b) by 0 days.

(21) Appl. No.: 09/510,000

(22) PCT Filed: Sep. 29, 1998

(86) PCT No.: PCT/EP98/02083

§ 371 Date: Aug. 1, 2000

§ 102(e) Date: Aug. 1, 2000

(87) PCT Pub. No.: WO99/17013

PCT Pub. Date: Apr. 8, 1999

(30) Foreign Application Priority Data

Oct. 1, 1997 (FR) ..... 97 12206
May 25, 1998 (FR) ..... 98 06524

(51) Int. Cl.[7] ..... F04F 5/48; F04F 5/00
(52) U.S. Cl. ..... 417/182; 417/184; 417/151
(58) Field of Search ..... 417/182, 184, 417/151

(56) References Cited

U.S. PATENT DOCUMENTS 571,692 A * 11/1896 Schneible ..... 417/184
3,771,913 A 11/1973 MacPherson et al. ..... 417/179
3,922,113 A 11/1975 Turner ..... 417/79
4,408,961 A 10/1983 Laybourne ..... 417/189
4,631,004 A * 12/1986 Mock ..... 417/189
5,954,481 A * 9/1999 Baier et al. ..... 417/182

FOREIGN PATENT DOCUMENTS

| | | |
|---|---|---|
| DE | 2346299 | 3/1975 |
| DE | 2602234 | 4/1977 |
| DE | 3612194 | 10/1986 |
| DE | 3915185 | 10/1990 |
| DE | 9101313 | 4/1991 |
| DE | 4201037 | 7/1993 |
| EP | 044494 | 1/1982 |
| FR | 2753748 | 3/1998 |

OTHER PUBLICATIONS

S.R.C. Laboratories: "Two stage nozzle adjusts suction to fluid bulk" vol. 47, No. 4, Feb. 20, 1975.

* cited by examiner

*Primary Examiner*—Charles G. Freay
*Assistant Examiner*—Michael K. Gray
(74) *Attorney, Agent, or Firm*—Blakely Sokoloff Taylor & Zafman

(57) ABSTRACT

The present invention relates to a jet pump, in particular for transferring fuel in a motor vehicle fuel tank, the pump being characterized by the fact that it comprises a main nozzle (20) and a core (30) mounted to move relative to the outlet bore of the main nozzle (20) and downstream therefrom.

21 Claims, 4 Drawing Sheets

FIG. 5
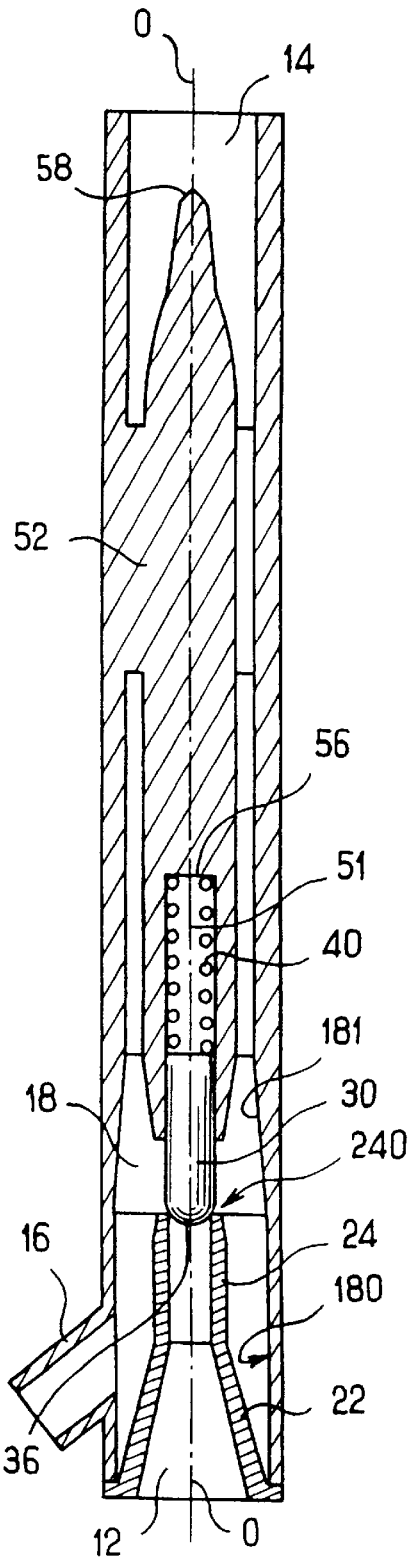
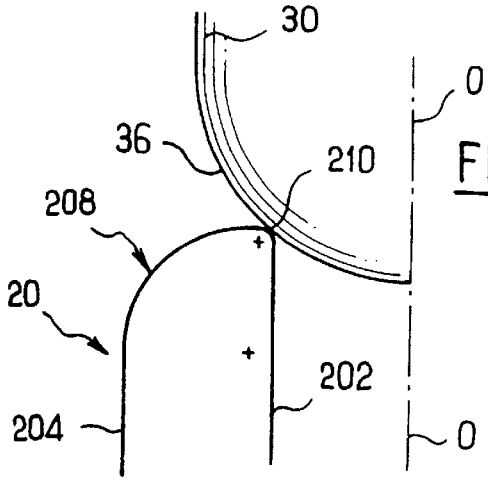
FIG. 7
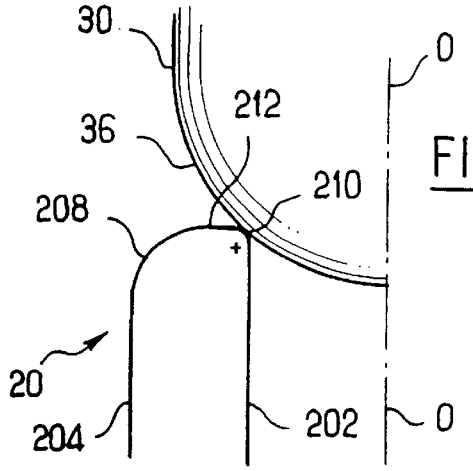
FIG. 8
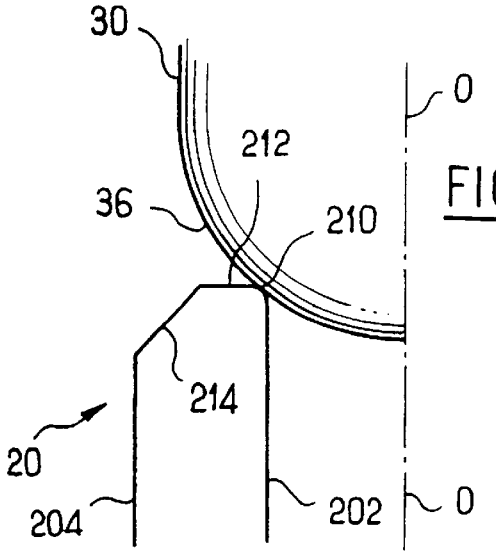
FIG. 9

JET PUMP COMPRISING A JET WITH VARIABLE CROSS-SECTION

The present invention relates to the field of jet pumps.

The present invention is particularly, but not exclusively, applicable in the field of fuel tanks for motor vehicles.

Still more precisely, the present invention can be applied in transferring fuel between various chambers of a multi-chamber fuel tank, or for filling a reserve bowl from which fuel is drawn by a fuel pump or any other fuel supply device.

Examples of fuel suction devices based on jet pumps are shown in documents DE-A-3 915 185, DE-A-3 612 194, and DE-A-2 602 234.

Although known suction devices based on jet pumps have given good service, they nevertheless do not always give satisfaction.

In particular, it has been observed that the flow injected into the jet pump, and corresponding to fuel being returned from the engine or to a fuel bypass taken from the outlet of the pump, can sometimes present fluctuations in pressure and/or flow rate that are large so that it is difficult to match the characteristics of the jet pump, and in particular to avoid large back pressures appearing at the inlet of the jet pump if the section of its outlet bore is too narrow for the injected flow rate and/or pressure.

Various proposals have been made in an attempt to eliminate that drawback.

Thus, for example, document DE-A-4 201 037 proposes a plunger core carried by a spring-biased membrane and placed inside the nozzle, upstream from its outlet bore, such that the plunger core moves back in the event of pressure increasing, thereby increasing the free section of the nozzle bore. In a variant, document DE-A-4 201 037 proposes making the body of the nozzle itself in the form of an element that is deformable relative to a fixed plunger core, likewise to adapt the section of the outlet bore to the injected pressure.

In its French patent application No: 96 11739 filed on Sep. 26, 1996, the Applicant has itself proposed a jet pump in which the nozzle which receives the injected flow is made up of a bore comprising a plurality of lips of elastic material that are adapted do that the section of the bore varies depending on the injected pressure and flow rate.

Other known solutions consist in placing a discharge valve upstream from the nozzle or the inlet for the injected flow of the jet pump, which valve is suitable for opening when the injected pressure exceeds a rated threshold for the valve. Nevertheless, those solutions present the drawback of losing a portion of the fluid that is bypassed via the valve, such that this portion of the fluid is not injected into the nozzle.

An object of the present invention is now to propose a novel and improved jet pump.

In the context of the present invention, this object is achieved by a jet pump comprising a nozzle and a core mounted to move relative to the outlet bore of the nozzle and downstream therefrom. According to an advantageous characteristic of the present invention, the core is of right section that increases going away from the outlet bore of the nozzle.

In a variant embodiment in accordance with the present invention, the core is provided with a through longitudinal channel that forms an auxiliary nozzle. The operation of this variant embodiment is described below.

Other characteristics, objects, and advantages of the present invention will appear on reading the following detailed description with reference to the accompanying drawings, given as non-limiting examples, and in which:

Document DE-U-9101313 describes a jet pump for transferring fuel in a motor vehicle fuel tank, said pump comprising a conically-shaped cap mounted to move in register with the outlet bore of the main nozzle and downstream therefrom.

FIG. 5 is a longitudinal section view of a pump constituting a variant embodiment of the present invention, shown in the closed position;

FIGS. 6 to 9 show four variant embodiments of a nozzle end in accordance with the present invention;

Figure 1:
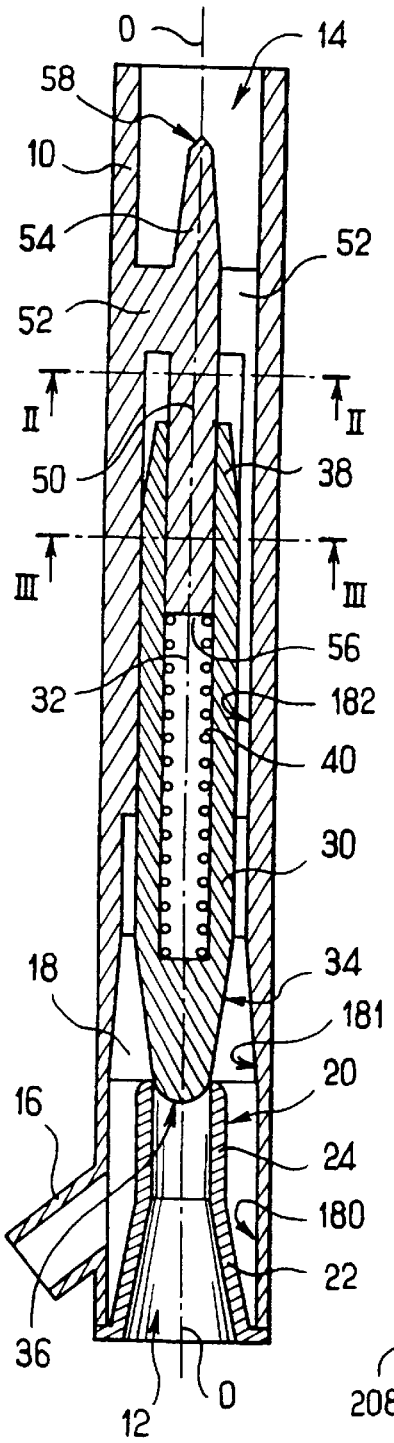
FIG. 1 is a diagrammatic longitudinal section view of a jet pump constituting an embodiment of the present invention.
Figure 2:
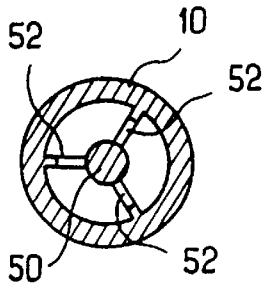
FIGS. 2 and 3 are diagrammatic cross-section views of the same pump on section planes referenced II and III in FIG. 1.

Accompanying FIG. 1 shows a jet pump in accordance with the present invention and comprising a cylindrical housing 10 centered on a longitudinal axis O—O.

At a first axial end thereof, the housing 10 defines a control inlet 12 receiving the injected flow.

The axial outlet 14 of the pump is defined at the opposite axial end thereof.

The housing 10 also has an auxiliary suction inlet 16 which communicates laterally with the internal channel 18 of the housing 10.

This auxiliary suction inlet 16 is located close to the control inlet 12. It can be constituted by a tube that slopes relative to the axis O—O of the housing, e.g. at an angle lying in the range 10° to 90°.

At its inlet 12, the housing 10 possesses a nozzle 20. This nozzle 20 is referred to below as the "main" nozzle. It can be constituted by a nozzle that is fitted to the inlet 12 as shown in FIG. 1, or by a nozzle that is made integrally with the housing 10, or with a segment of the housing 10. Naturally, sealing must be provided between the inlet of the nozzle 20 and the inlet 12 of the housing 10.

More precisely, in the preferred embodiment shown in the accompanying figures, the nozzle 20 comprises two segments 22 and 24 that are axially juxtaposed.

The first segment 22 in the flow direction is preferably converging and frustoconical in shape. The half-angle at the apex of this segment 22 preferably lies in the range 10° to 80°.

The second segment 24 of the nozzle 20 is preferably circularly cylindrical and constant in section. The free outer end 240 of this segment 24 is preferably slightly rounded. Various embodiments for such a nozzle end are described below with reference to FIGS. 6 to 9.

Over the axial length of the nozzle 20, the right section of the segment 180 of the channel 18 formed inside the housing 10 is preferably circularly cylindrical and of constant size.

As mentioned above, in the context of the present invention, a core 30 is placed in register with the outlet bore of the nozzle 20, being guided in translation along the axis O—O against bias from a spring 40.

The core 30 can be guided on the axis O—O by numerous suitable means.

Preferably, the core 30 is provided with a central internal blind channel 32 whose rear end remote from the nozzle 20 is open. The core 30 is engaged by means of this channel 32 on a rod 50 which is centered in the channel 18 and which is connected to the housing 10. By way of non-limiting example, this rod 50 can thus be supported by the inside surface of the housing 10, in the channel thereof, by means of three fins 52 that are uniformly distributed at 120° intervals around the axis O—O.

Over the major portion of its length, the section of the rod 50 is circularly cylindrical and of constant size complementary to the right section of the channel 32 formed in the core 30. Nevertheless, the rod 50 preferably possesses a tapering or converging frustoconical rear segment 54 going away from the nozzle 20.

The front face 56 of the rod 50 is preferably plane and orthogonal to the axis O—O. In contrast, the rear face 58 of the rod 50 is preferably rounded or conical.

The fins 52 are connected to the cylindrical portion of the rod 50 immediately upstream from its transition zone to the tapering segment 54.

The outer envelope of the core 30 is generally circularly cylindrical and of constant section.

Nevertheless, the core 30 has a frustoconical front segment 34 terminated by a front end 36 that is generally hemispherical or bullet-shaped. The core 30 also has a rear segment 38 that is frustoconical.

The spring 40 is advantageously a helical compression spring placed in the channel 32 of the core 30 between the front face 56 of the rod 50 and the end wall of the channel 32.

The person skilled in the art will thus readily understand that the spring 40 urges the core 30 to press against the outlet bore of the nozzle 20, and more precisely against the rear surface 240 of the segment 24 or against a contact generator line thereof.

The core 30 thus preferably rests against the free end 240 of the segment 24 in the form of a zone that is defined substantially by a circular edge or on a contact generator line defined in the transition zone between the diverging frustoconical segment 34 and the hemispherical front end 36.

Downstream from the initial segment 180 of constant light section and of length coinciding with the length of the nozzle 20, the channel 18 constituted by the housing 10 can have a segment 181 that converges towards the outlet 14, and that is in turn followed by a segment 182 of constant cylindrical right section.

The length of the converging segment 181 is advantageously equal to the length of the diverging segment 34 of the core 30.

Figure 3:
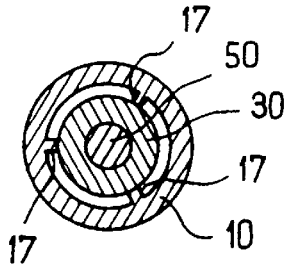
Figure 4:
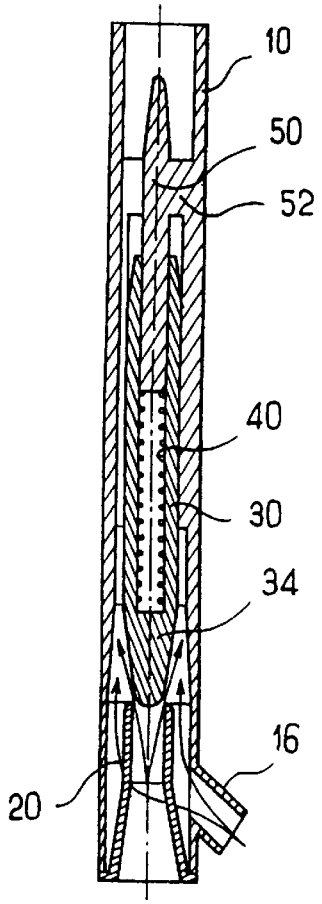
FIG. 4 is a view of the same pump with the nozzle in its open position.

Finally, as can be seen from FIGS. 1 and 3, the core 30 is advantageously guided along the axis O—O via its circularly cylindrical segment by means of guide splines 17, e.g. three guide splines uniformly distributed at 120° intervals. These splines preferably extend from the fins 52.

It is important to observe that in the context of the present invention, the contact zone defined between the front end of the core 30 and the outlet bore of the nozzle 20 is of limited amplitude.

Figure 6:
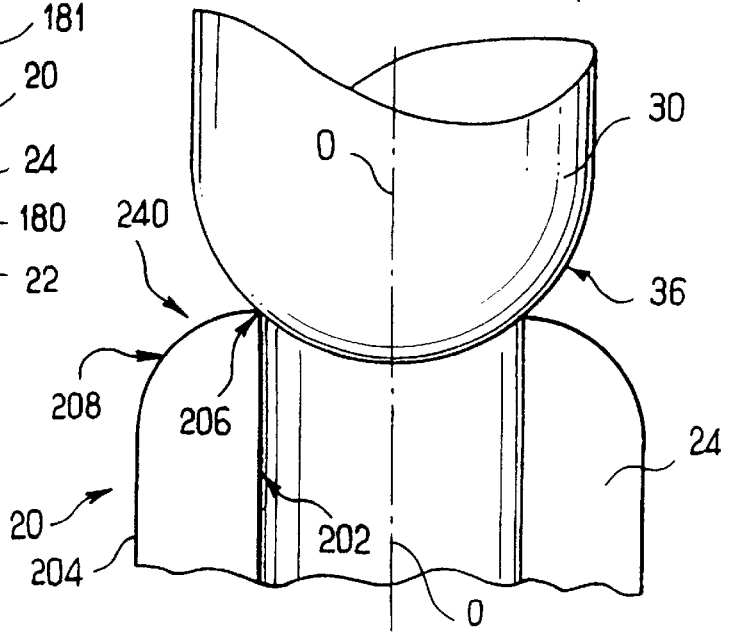

FIG. 6 shows a first variant embodiment of the end 240 of the nozzle 20. In this first variant, the inner surface 202 and the outer surface 204 of the segment 24 of the nozzle 20 are circularly cylindrical about the axis O—O , while the end 240 of the nozzle 20 is formed by a toroidal cap 208, i.e. it is defined in right section by a circular sector which runs tangentially into the outer surface 204 and which meets the inner surface 202 at a circular edge 206, which edge 206 defines the rest contact with the core 30. The angle defined between the toroidal cap 208 and the inner surface 202 where these join can be implemented in various sizes. It is typically about 90°.

The second embodiment of the end 240 of the nozzle 20 shown in FIG. 7 differs from that shown in FIG. 6 as described above by the fact that the toroidal cap 208 no longer connects to the inner surface 202 via a circular edge 206, but connects tangentially via a radially-inner, second toroidal surface 210 which in turn connects tangentially with the inner surface 202. The rest contact between the core 30 and the nozzle 20 is thus defined at said toroidal surface 210. The radially-inner, second toroidal surface 210 has a radius of curvature which is smaller than that of the radially-outer toroidal surface 208. In typical but non-limiting manner, the radius of the radially-outer toroidal surface 208 is about 1 mm to 2 mm, while the radius of the radially-inner toroidal surface 210 is about 0.05 mm to 0.5 mm.

FIG. 8 shows a third variant embodiment in which a plane ring-shaped surface 212, or possibly conical surface, is interposed between the two toroidal surfaces 208 and 212.

Finally, FIG. 9 shows a fourth variant embodiment which differs from that shown in FIG. 8 by the fact that the radially-outer toroidal surface 208 is replaced by a frustoconical surface or chamfer 214.

Naturally, the end 240 of the nozzle 20 can be implemented in a wide variety of ways.

Thus, it is possible to envisage connecting the chamber 214 directly to the radially-inner surface 210. Or else the toroidal surface 208 could be replaced by an annular surface whose generator line in right section possess a radius that increases progressively outwards.

The architecture of the jet pump of the present invention makes it possible to avoid having any discharge valve upstream from the nozzle 20. Thus, the invention makes it possible to avoid any of the return flow being lost in the form of an external discharge, such that the injected flow Qi is always equal to the return flow.

At the lowest injected flows, the delivery section, i.e. the free section of the nozzle 20, is small and makes it possible to increase the power which is transmitted to the jet pump by using a high injection pressure Pi.

At high return flow rates, the core 30 backs away from the nozzle 20 by compressing the spring 40, thereby increasing the outlet flow section from the nozzle and limiting the back pressure upstream from the nozzle 20 to an acceptable value.

Using a Venturi core 30 that moves in translation downstream from the nozzle 20 thus makes it possible to guarantee optimum efficiency for the jet pump at the lowest injected flow rate Qi (by reducing the diameter of the nozzle 20 and increasing the injection speed).

The outlet flow from the nozzle 20 is in the form of a conical film channeled by the converging portion towards the annular mixer.

By way of non-limiting example, the cone angle of the segment 34 of the core is about 8°, of the segment 38 of the core is about 9°, of the segment 181 of the channel 18 is about 5°, and of the segment 54 of the rod 50 is about 6°.

Accompanying FIG. 5 shows a variant embodiment which is not described in detail below, and which differs from the above-described embodiment essentially by the fact that the core element 38 biased by the spring 40 in register with the outlet bore of the nozzle 20 and downstream therefrom is guided in translation on the axis O—O by the rod 50 which is associated with the housing 10, but instead of being located outside the rod is now located inside the rod, and more precisely in a blind channel 51 which opens out to the front surface of the rod 50.

Figure 10:
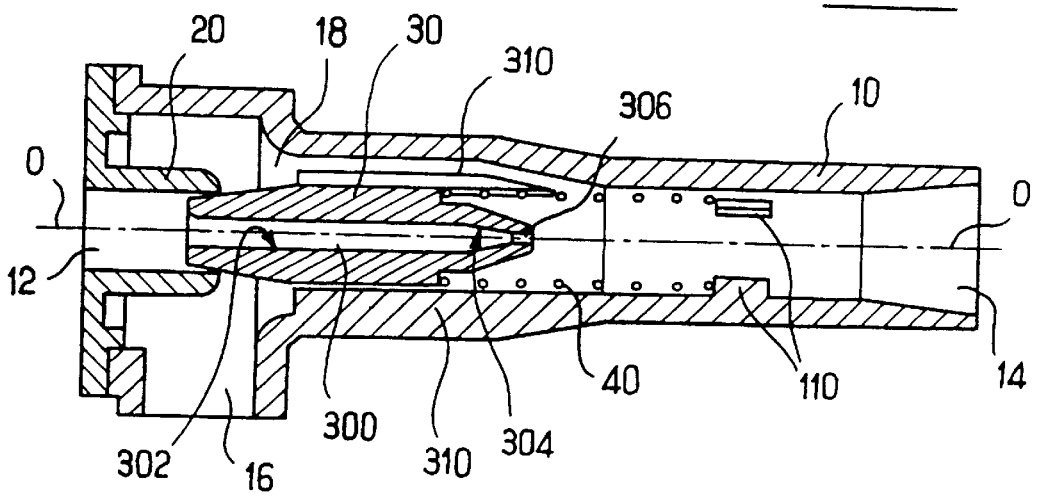
FIG. 10 is a diagrammatic longitudinal section view of a jet pump constituting a variant embodiment of the present invention.
Figure 11:
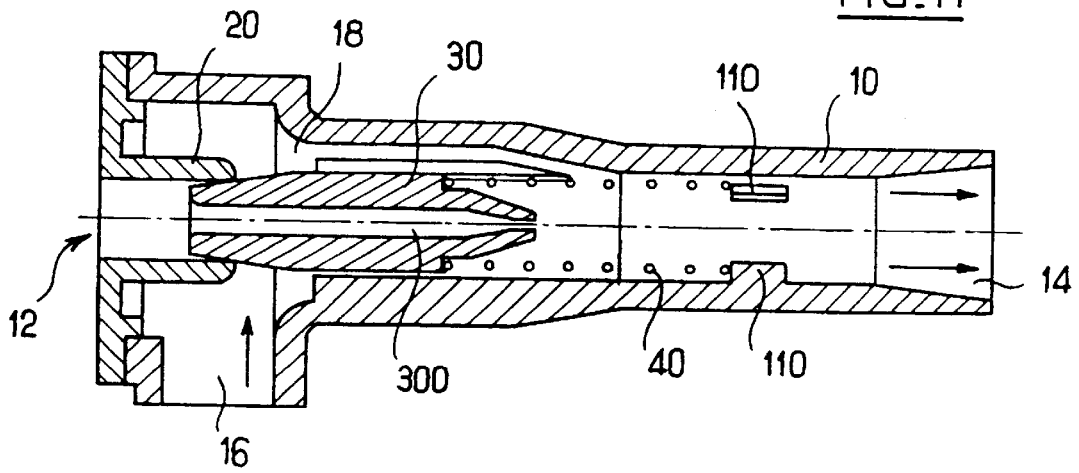
FIGS. 11 and 12 show the same variant for two different flow rates injected into the pump.
Figure 12:
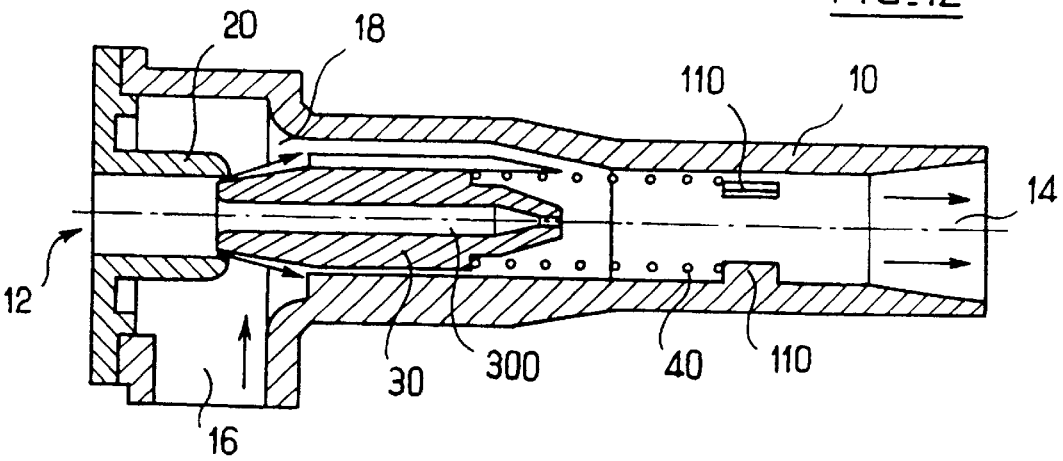

There follows a description of the variant embodiment shown in accompanying FIGS. 10 to 12.

This variant differs from those described above essentially by the fact that in FIGS. 10 to 12 the core 30 is provided with a through longitudinal channel 300. This forms an auxiliary nozzle whose function is described below.

The shape of this channel 300 can be implemented in various different ways.

In the embodiment shown in FIGS. 10 to 12, the channel 300 is made up of three successive segments 302, 304, and 306 which follow one another starting from the nozzle 20 and going towards the outlet of the pump.

The first segment 302 is circularly cylindrical and of constant section. Typically, it occupies ⅘ths of the length of the core 30.

The second segment 304 converges towards the outlet of the pump.

The third segment 306 is circularly cylindrical and of section that is at least substantially constant.

Typically, the outlet diameter of the channel 300, i.e. the outlet diameter of the segment 306 (constituting the auxiliary nozzle) lies in the range 0.4 mm to 1 mm.

As described above for the embodiments shown in FIGS. 1 to 9, the core 30 is guided in translation in register with the outlet from the nozzle 20 and is urged towards said outlet by a spring 40.

The core 30 can be guided in translation by any appropriate means; In the non-limiting embodiment shown in FIGS. 10 to 12, longitudinal fins 310 are provided for this purpose on the inner face of the housing 10, e.g. three fins 310 distributed at 120° intervals, which together define a free internal volume that is complementary to the outer envelope of the core 30. In a variant, the fins 310 can be integral with the core 30.

Naturally, in this variant it is important to use guide means which disturb neither the operation of the auxiliary nozzle 300 nor the flow that can occur between the outlet bore of the nozzle 20 and the outer surface of the core 30, i.e. means which do not obstruct these flows.

The spring 40 can be configured in various ways.

In the embodiment shown in FIGS. 10 to 12, it is constituted by a spiral spring which bears firstly against a step of the core 30, and secondly against the upstream ends of the fins 110 which are secured to the inner wall of the housing 10, e.g. three fins 110 distributed at 120° intervals.

The dispositions shown in FIGS. 10 to 12 make it possible to increase the suction performance of the annular jet pump at very low injected flow rates (typically for flows of less than 20 liters per hour (1/h)) while still limiting the back pressure (or injection pressure) at maximum flow rate.

When the flow in the inlet 12 is zero, the same applies to the flow in the suction inlet 16, and to the flow at the outlet 14 (see FIG. 10). Under such circumstances, the core 30 rests against the end of the nozzle 20.

When the flow Qi injected into the inlet 12 is low, the back pressure Pi remains below the threshold Ps for opening the core 30 (this is a function of the rating of the compression spring 40), thereby causing injection to take place through the auxiliary nozzle formed by the longitudinal channel 300 through the core 30 (see FIG. 11). The Venturi effect then takes place in conventional manner and the transferred flow is collected via the mixer tube situated downstream from the core 30.

With increasing flow Qi injected into the inlet 12, the back pressure exceeds the pressure threshold Ps and the core 30 moves progressively away from the nozzle by deforming the spring 40, thereby releasing an annular flow section between the core 30 and the nozzle 20, as described above with reference to FIGS. 1 to 9. This off-loading makes it possible to limit the increase in pressure above Ps at high injected flows Qi while guaranteeing a secondary Venturi effect at the outlet from the nozzle 300, which contributes to increasing the flow Qa that is sucked in through the inlet 16 after the core 30 has been moved back (see FIG. 12).

Naturally, the present invention is not limited to the particular embodiments described above, but extends to any variant within the spirit of the invention.

In particular, it should be observed that a single flow annular jet jump can be obtained using the architecture shown in FIGS. 10 to 12, by blocking the channel 300 made in the core 30.

Figure 13:
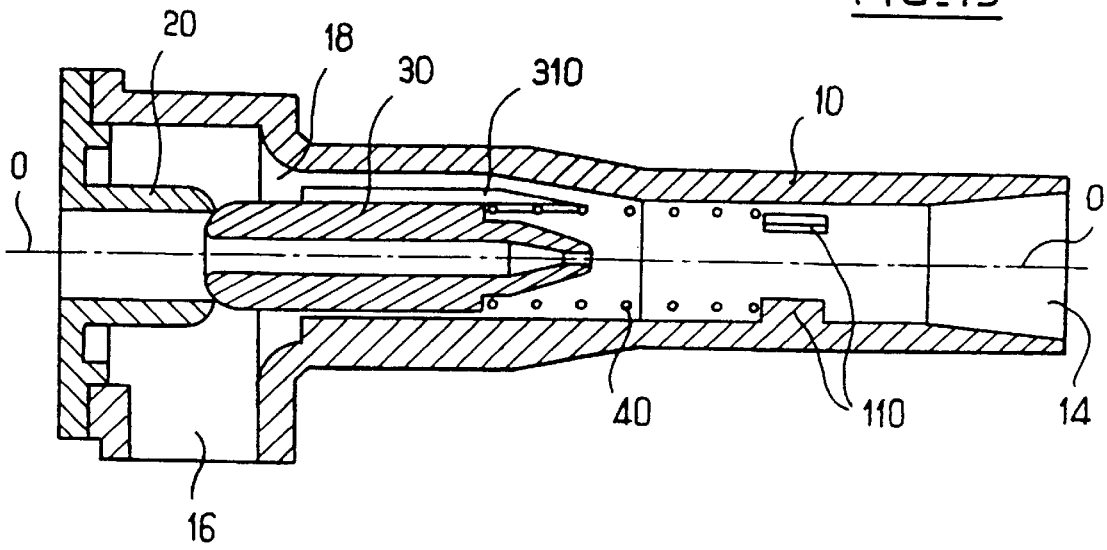
FIGS. 13 and 14 are longitudinal section views of two other variant embodiments of the present invention.
Figure 14:
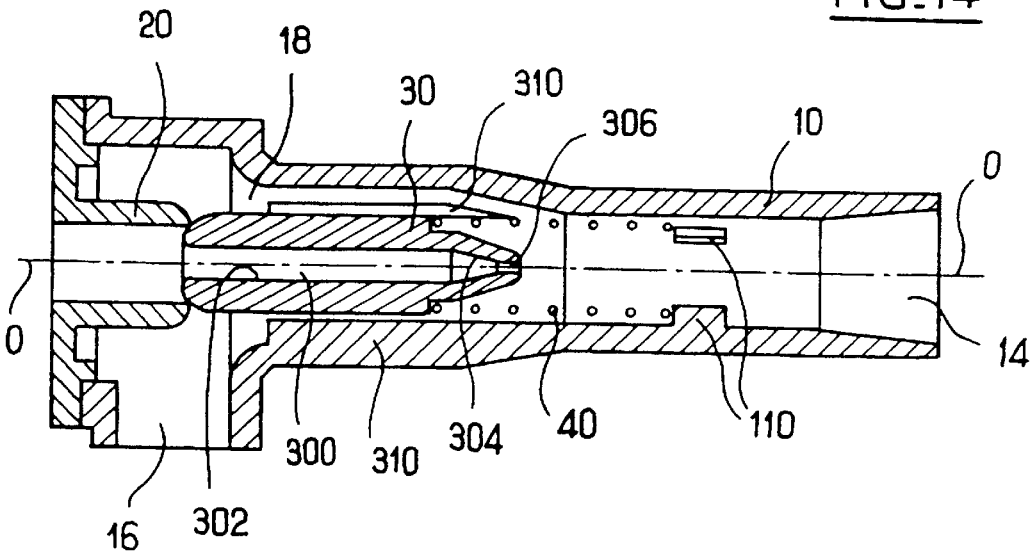

FIG. 14 shows a variant of the dual-flow embodiment in which the core 30 with a through longitudinal channel 300 rests against the outlet from the nozzle 20 via a bearing surface of hemispherical or semi-toroidal shape (whereas the bearing surface of the core 30 is generally frustoconical in FIGS. 10 to 12); and FIG. 13 shows a variant embodiment which differs from that of FIG. 14 solely by the fact that the channel 300 is obstructed. Thus, the embodiment of FIG. 13 corresponds to a single flow. In both of the cases shown in FIGS. 13 and 14, the core 30 is guided by fins 310 as described with reference to FIGS. 10 to 12; the spring 40 bears against the core 30 and against fins 110 secured to the housing 10.

What is claimed is:

1. A jet pump, in particular for transferring fuel in a motor vehicle fuel tank, the pump comprising a housing (10), a main nozzle (20) provided in the center of the housing and connected to receive a flow of fuel under pressure and a core (30) mounted in the housing downstream the output of the main nozzle to move relative to an outlet bore (240) of the main nozzle (20) wherein the pump further comprises spring means (40) which at rest, biases said core (30) in contact with the outlet bore of the main nozzle (20) so that when the pressure of the flow of fuel introduced into said main nozzle is under a predetermined level, said core is in contact with the output of the main nozzle and forbids any flow of fuel between said output of the main nozzle and the core, while when the pressure of the flow of fuel introduced into said main nozzle is above said predetermined level, said core is displaced at distance of the output of the main nozzle to allow a flow of fuel between said output of the main nozzle and the core.

2. A pump according to claim 1, characterized by the fact that the core (30) has a cross section that increases going away from the outlet bore of the main nozzle (20).

3. A pump according to claim 1, characterized by the fact that the core (30) is provided with a through longitudinal channel (300) forming an auxiliary nozzle (306).

4. A pump according to claim 3, characterized by the fact that the outlet diameter of the through channel (300) lies in the range 0.4 mm to 1 mm.

5. A pump according to claim 1, characterized by the fact that the main nozzle (20) possesses a converging segment (22) followed by a segment of constant section (24).

6. A pump according to claim 1, characterized by the fact that the half-angle at the apex of the main nozzle (20) lies in the range 10° to 80°.

7. A pump according to claim 1, characterized by the fact that the end of the outlet bore of the main nozzle (20) is generally rounded in shape.

8. A pump according to claim 1, characterized by the fact that the core (30) possesses a generally frustoconical front segment (34) terminated by a front end (36) that is generally hemispherical or bullet-shaped.

9. A pump according to claim 8, characterized by the fact that the cone angle of the front segment of the core (30) is about 8°.

10. A pump according to claim 1, characterized by the fact that the core (30) possesses a generally cylindrical envelope of constant section.

11. A pump according to claim 1, characterized by the fact that the core (30) possesses a rear segment (38) that converges going away from the main nozzle (20).

12. A pump according to claim 1, characterized by the fact that it includes a spring (40) interposed between the front end of a support (50) and the core (30).

13. A pump according to claim 1, characterized by the fact that the core is guided by support means associated with the inner wall of the housing (10) by radial fins (52).

14. A pump according to claim 1, characterized by the fact that the housing (10) of the pump defines an internal channel possessing a segment (181) that converges in the flow direction, and that is located in register with the diverging segment of the core (30).

15. A pump according to claim 14, characterized by the fact that the length of the converging segment of the channel (18) formed inside the housing (10) is of the same order of magnitude as the length of the diverging segment (34) formed on the core (30).

16. A pump according to claim 1, characterized by the fact that the core (30) is guided inside the channel (18) of the housing (10) by radial splines (17) associated with the inner surface of the channel (18).

17. A pump according to claim 1, characterized by the fact that the contact defined between the core (30) and the outlet bore (240) of the main nozzle (20) is formed by a circular edge (206).

18. A pump according to claim 1, characterized by the fact that the core (30) and the outlet bore (240) of the main nozzle (20) is formed via a generally toroidal cap (210) of said outlet bore.

19. A pump according to claim 18, characterized by the fact that the radius of said generally toroidal cap (210) lies in the range 0.05 mm to 0.5 mm.

20. A pump according to claim 3, characterized by the fact that the longitudinal channel (300) in the core (30) has a converging segment (304).

21. A fuel tank fitted with a jet pump in accordance with any one of claims 1 to 20.

* * * * *

UNITED STATES PATENT AND TRADEMARK OFFICE

CERTIFICATE OF CORRECTION

PATENT NO. : 6,364,625 B1
DATED : April 2, 2002
INVENTOR(S) : Sertier

It is certified that error appears in the above-identified patent and that said Letters Patent is hereby corrected as shown below:

Column 8,
Line 23, please delete "any one of claims 1 to 20." and insert -- claim 1. --.

Signed and Sealed this

Twenty-ninth Day of June, 2004

JON W. DUDAS
*Acting Director of the United States Patent and Trademark Office*